US007585180B2

(12) United States Patent
Riner et al.

(10) Patent No.: US 7,585,180 B2
(45) Date of Patent: Sep. 8, 2009

(54) METHOD AND APPARATUS FOR CONTAINING A CONDUCTOR CARRIER IN AN ELECTRICAL CONNECTOR

(75) Inventors: Raymond H. Riner, Fort Wayne, IN (US); Andrew T. Blotkamp, Garrett, IN (US); Wesley R. Kallsen, Hicksville, OH (US)

(73) Assignee: Group Dekko, Inc., Kendallville, IN (US)

( * ) Notice: Subject to any disclaimer, the term of this patent is extended or adjusted under 35 U.S.C. 154(b) by 0 days.

(21) Appl. No.: 11/554,314

(22) Filed: Oct. 30, 2006

(65) Prior Publication Data

US 2008/0102673 A1 May 1, 2008

(51) Int. Cl.
*H01R 13/58* (2006.01)

(52) U.S. Cl. ..... 439/459

(58) Field of Classification Search ..... 439/459, 439/474, 460, 456, 455, 465, 467, 621, 622, 439/492–499

See application file for complete search history.

(56) References Cited

U.S. PATENT DOCUMENTS 5,133,674 A * 7/1992 Albrecht ..... 439/465
5,252,081 A * 10/1993 Hart ..... 439/98
5,310,362 A * 5/1994 Bauerle et al. ..... 439/620.21
5,713,757 A 2/1998 Karst et al.
5,860,832 A * 1/1999 Wayt et al. ..... 439/465
6,443,758 B2 * 9/2002 Nagai ..... 439/465
6,561,465 B2 * 5/2003 Kondo ..... 248/74.3
6,746,269 B1 * 6/2004 Casses ..... 439/422
6,793,520 B1 * 9/2004 Wu ..... 439/459
2003/0087547 A1 5/2003 Plattner et al.

* cited by examiner

*Primary Examiner*—Alexander Gilman
(74) *Attorney, Agent, or Firm*—Taylor & Aust, P.C.

(57) ABSTRACT

The present invention, in one form, is directed to an electrical assembly including a conductor carrier, a plurality of conductors at least partially within the conductor carrier, and an electrical connector coupled with the plurality of conductors. The electrical connector includes a housing member and at least one post. The housing member includes a first wall and a second wall. The post is connected to the first wall, extends toward the second wall, extends through the conductor carrier, and terminates at least near the second wall, the post being disposed between at least two of the plurality of conductors. In an embodiment of the present invention, the post transversely pierces the conductor carrier.

20 Claims, 5 Drawing Sheets

METHOD AND APPARATUS FOR CONTAINING A CONDUCTOR CARRIER IN AN ELECTRICAL CONNECTOR

BACKGROUND OF THE INVENTION

1. Field of the Invention

The present invention relates to modular panels, and, more particularly, to an electrical assembly which electrically connects modular wall panels, the electrical assembly including an electrical connector which contains an end of a conductor carrier.

2. Description of the Related Art

Modular wall panels are often used in office settings to separate workspaces. These workspaces are provided with electric power. To provide the electric power to the workspaces, electrical assemblies, such as jumper assemblies or power feed cable assemblies, are often used to provide connection within the line from the power source to the electric load.

Electrical assemblies can include a conductor carrier, conductors running within the conductor carrier, and electrical connectors coupled with each end of the conductor carrier and with each end of the conductors. Ends of the conductor carrier must be coupled securely to the electrical connectors. That is, upon pulling the conductor carrier in a direction away from the electrical connector with a predetermined force (applying the "pull test"), the conductor carrier should not separate from the electrical connector. To pass the pull test, a certain type and number of conductors are required. For example, if any wires are removed from the electrical assembly, the electrical assembly will not pass the pull test. A different electrical connector would be needed to accommodate the fewer number of wires, so as to pass the pull test.

What is needed in the art is an electrical connector having a post which positively retains within the electrical connector an end of a conductor carrier without regard for the type and number of conductors.

SUMMARY OF THE INVENTION

The present invention provides an electrical connector having a post which positively retains within the electrical connector an end of a conductor carrier without regard for the type and number of conductors.

The invention in one form is directed to an electrical connector configured for connecting with a conductor carrier and a plurality of conductors at least partially within the conductor carrier. The electrical connector includes a housing member and at least one post. The housing member includes a first wall and a second wall. The post is connected to the first wall, extends toward the second wall, and terminates at least near the second wall. The post is configured for extending through the conductor carrier and retaining within the housing member an end of the conductor carrier. In an embodiment of the present invention, the post can be configured for piercing the conductor carrier.

The invention in another form is directed to an electrical assembly including a conductor carrier, a plurality of conductors at least partially within the conductor carrier, and an electrical connector coupled with the plurality of conductors. The electrical connector includes a housing member and at least one post. The housing member includes a first wall and a second wall. The post is connected to the first wall, extends toward the second wall, extends through the conductor carrier, and terminates at least near the second wall, the post being disposed between at least two of the plurality of conductors. In an embodiment of the present invention, the post transversely pierces the conductor carrier.

The invention in yet another form is directed to a method of assembling an electrical assembly, including the steps of providing, coupling, and retaining. The step of providing includes providing a conductor carrier, a plurality of conductors at least partially within the conductor carrier, and an electrical connector coupled with the plurality of conductors and including a housing member, the housing member including a first wall and a second wall. The step of coupling includes coupling the conductor carrier with at least one post, wherein the post is connected to the first wall, extends toward the second wall, extends through the conductor carrier, and terminates at least near the second wall, the post being disposed between at least two of the plurality of conductors. The step of retaining includes retaining within the housing member an end of the conductor carrier. In an embodiment of the present invention, the coupling step includes the post transversely piercing the conductor carrier.

An advantage of the present invention is that it provides a simple mechanism for retaining an end of a conductor carrier, such as a mesh sleeve, within an electrical connector.

Another advantage is that the present invention provides an electrical connector which retains the mesh sleeve end while accommodating various types and numbers of conductors.

Yet another advantage is that the present invention provides a more economical electrical assembly.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, in more than one form, and such exemplifications are not to be construed as limiting the scope of the invention in any manner.

DETAILED DESCRIPTION OF THE INVENTION

Figure 2:
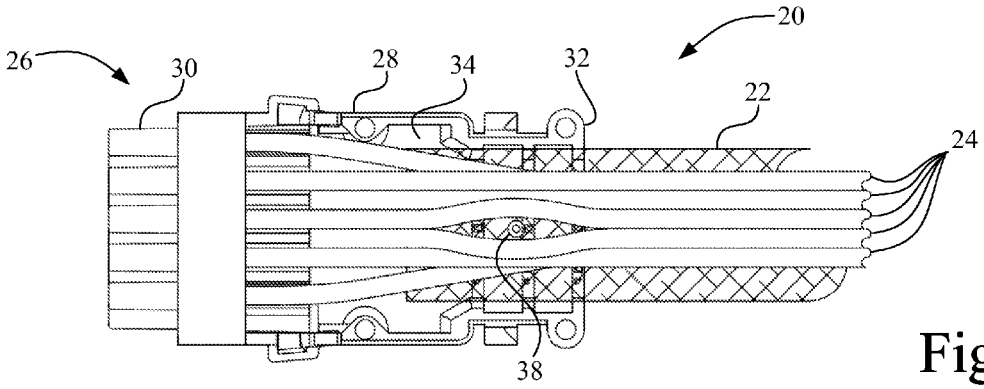
FIG. 2 is a sectional, bottom interior view of the electrical assembly in FIG. 1 without the mesh sleeve completely surrounding the wires.
Figure 1:
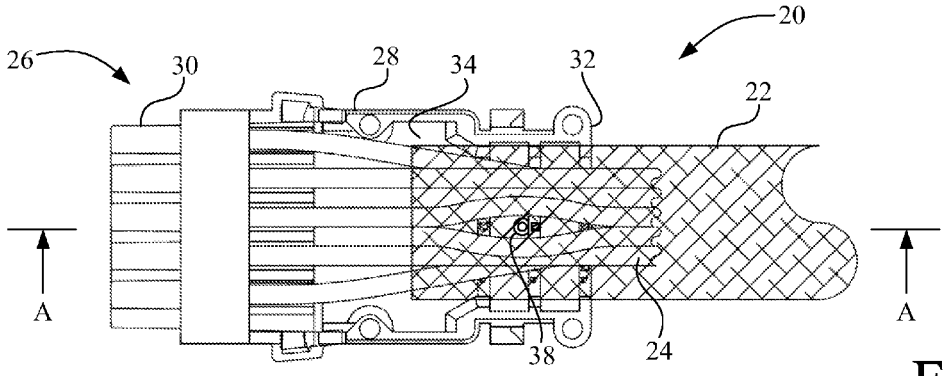
FIG. 1 is a sectional, bottom interior view of an electrical assembly according to the present invention showing a mesh sleeve surrounding wires.
Figure 3:
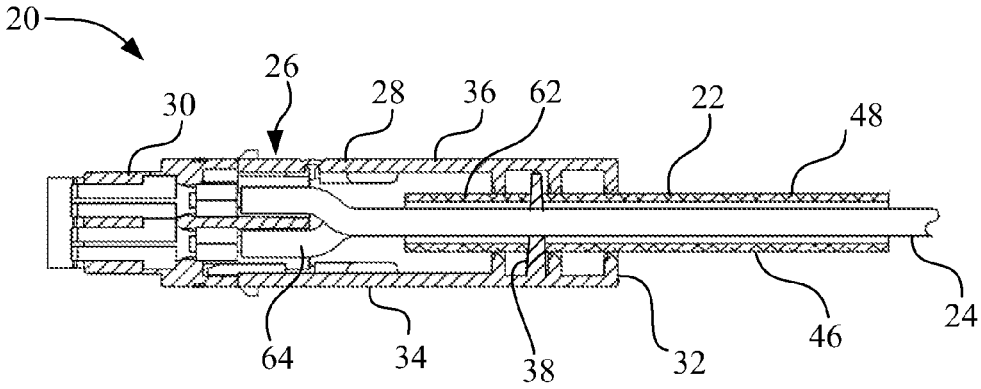
FIG. 3 is a sectional, bottom interior view of the electrical assembly in FIG. 1 taken along line A-A in FIG. 1 showing the post of the present invention, the mesh sleeve, and the wires.
Figure 4:
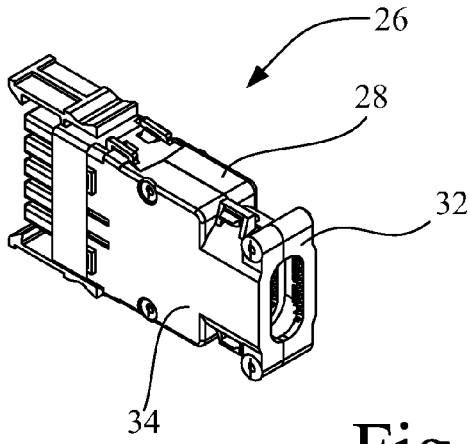
FIG. 4 is a perspective view of an electrical connector.
Figure 5:
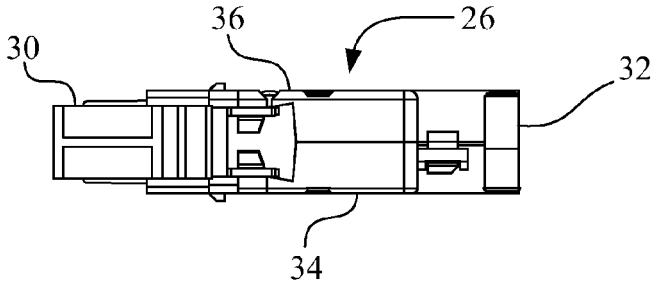
FIG. 5 is a side view of the electrical connector in FIG. 4.
Figure 6:
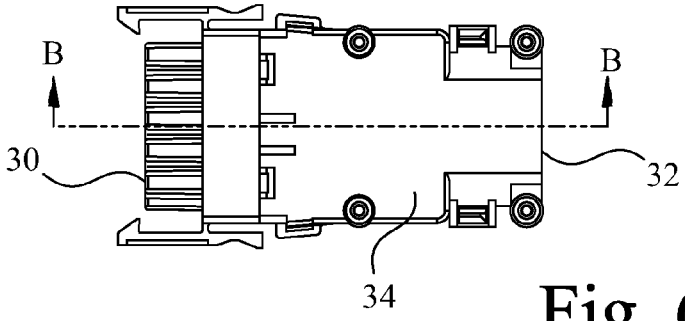
FIG. 6 is a bottom-side exterior view of the electrical connector in FIG. 4.
Figure 7:
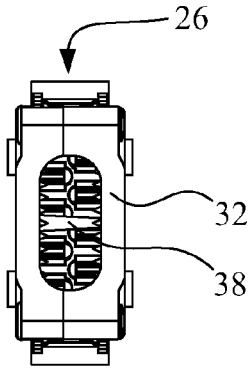
FIG. 7 is a front view of the electrical connector in FIG. 4 showing the post of the present invention.

Referring now to the drawings, and more particularly to FIGS. 1-3, there is shown an electrical assembly 20 which generally includes a conductor carrier 22, a plurality of conductors (i.e., wires) 24, and at least one electrical connector 26. Electrical assembly 20 can be, but is not limited to, a power feed assembly with a power feed connector or a jumper assembly.

Conductor carrier 22 can be a mesh sleeve which is pulled over wires 24. Conductor carrier 22 includes a bottom portion 46, a top portion 48, and an end 62. Conductor carrier 22 can include one or more pre-fabricated holes (not shown) in bottom and top portions 46, 48.

Wires 24 are located at least partially within mesh sleeve 22 and include ends 64. Additionally, while FIGS. 1-2 show seven wires, more or less wires and various types of wires can be accommodated by conductor carrier 22 and electrical connector 26 depending upon the application.

Figure 8:
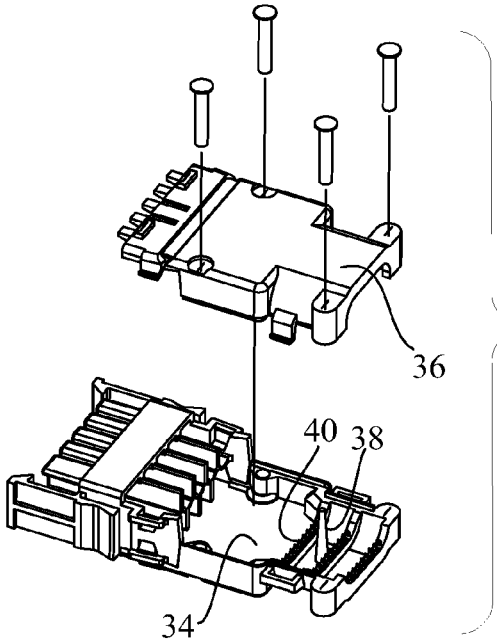
FIG. 8 is an exploded, perspective view of the electrical connector in FIG. 4 showing the post of the present invention.
Figure 9:
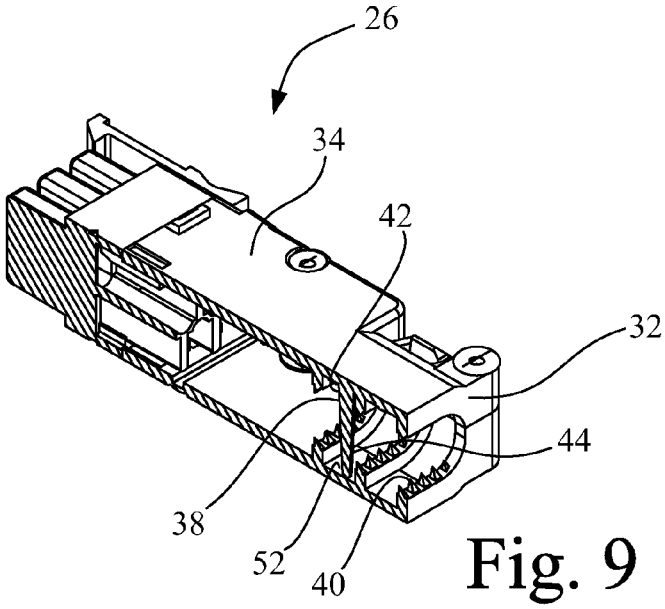
FIG. 9 is a perspective, cross-sectional view of the electrical connector in FIG. 4 taken along line B-B in FIG. 6 showing one embodiment of the present invention.
Figure 10:
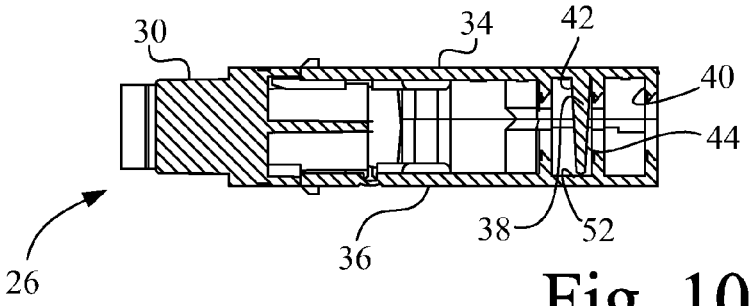
FIG. 10 is a side, cross-sectional view of the electrical connector in FIG. 4 taken along line B-B in FIG. 6 showing the embodiment of the present invention of FIG. 9.
Figure 11:
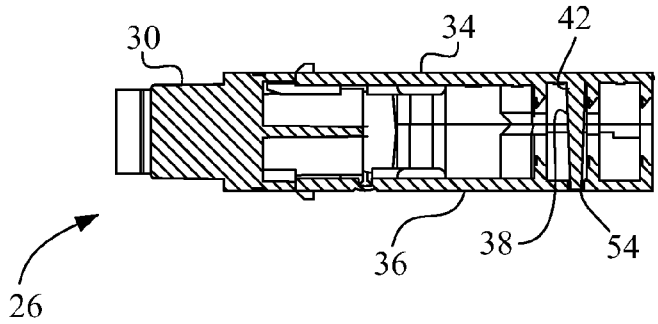
FIG. 11 is a side, cross-sectional view of the electrical connector in FIG. 4 taken along line B-B in FIG. 6 showing another embodiment of the present invention.
Figure 12:
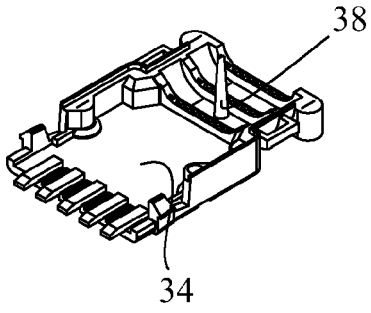
FIG. 12 is a perspective, sectional, bottom interior view of an electrical connector showing the post of the present invention.

Electrical connector 26 is configured for connecting with conductor carrier 22 and conductors 24. As shown in FIGS. 1-8, electrical connector 26 includes a housing 28. Housing 28 includes two opposing ends, a first end 30 having terminals and a second end 32. The terminals of first end 30 couple with ends 64 of wires 24. Housing 28 is entered through second end 32 by conductor carrier 22 and wires 24. Housing 28 also includes a bottom wall 34, a top wall 36, and at least one post 38; housing 28 can, thus, include a single post 38 or a plurality of posts 38. Bottom and top walls 34, 36 of housing 28 are respectively adjacent to bottom and top portions 46, 48 of mesh sleeve 22. Bottom and top walls 34, 36 can be detachable relative to one another, as shown in FIG. 8. As shown in FIGS. 9-10, housing top wall 36 includes an inner surface 52. Inner surface 52 can be level as shown in FIGS. 9-10, can define a recess 54 as shown in FIG. 11, or can define a hole (not shown). Housing 28 can include a plurality of teeth 40 arranged in a plurality of rows within housing 28 in a region of housing second end 32. Additionally, various types and shapes of housing 28 can be used according to the present invention.

Figure 14:
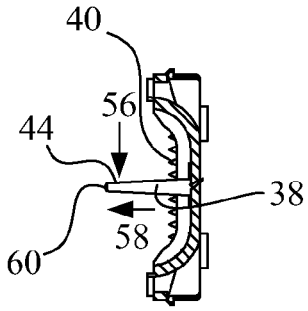
FIG. 14 is a sectional, back, cross-sectional view of the electrical connector in FIG. 12 taken along line C-C in FIG. 13.

As shown in FIG. 9, post 38 has a first end 42 and a second end 44. Post first end 42 is connected to bottom wall 34 in the region of second end 32 of housing 28. From bottom wall 34, post 38 extends toward top wall 36 in a longitudinal direction 58 of post 38, as also shown in FIG. 14. Post second end 44 terminates at least near top wall 36. Post second end 44 can contact top wall 36. In so extending between bottom and top walls 34, 36, post 38 extends through mesh sleeve 22 in a direction transverse to a running direction of mesh sleeve 22, as shown in FIGS. 1-3. In extending transversely through mesh sleeve 22, post 38 is disposed between at least two wires 24, as shown in FIGS. 1-2.

In extending transversely through mesh sleeve 22, post 38 enters bottom portion 46 of mesh sleeve 22, passes by wires 24, and exits mesh sleeve 22 through top portion 48 of mesh sleeve 22. In entering and exiting bottom and top portions 46, 48 of mesh sleeve 22, post 38 can transversely pierce bottom and top portions 46, 48. Alternatively, post 38 (or the plurality of posts 38) can slidably enter and/or exit the one or more pre-fabricated holes (not shown) in bottom and/or top portions 46, 48 of conductor carrier 22. Post 38 does not necessarily exit top portion 48 of mesh sleeve 22. Post 38 can be mounted to top wall 36 of housing 28, rather than bottom wall 34.

As shown in FIGS. 9-10, post second end 44 terminates at—that is, contacts—inner surface 52 of top wall 36 at a place of contact between post second end 44 and inner surface 52, inner surface 52 of the place of contact being substantially level with inner surface 52 which surrounds the place of contact. Alternatively, post second end 44 can terminate near but not contact inner surface 52, inner surface 52 being substantially level in a region of inner surface 52 near post second end 44. Alternatively, as shown in the embodiment of the present invention in FIG. 11, post second end 44 can enter and terminate in recess 54, recess 54 being complementary in shape to post second end 44. Alternatively, post second end can enter and terminate in the hole (not shown) in top wall inner surface 52, the hole being complementary in shape to post second end 44.

Post 38 has a transverse cross-section in a direction 56 transverse to longitudinal direction 58 of post 38, as shown in FIG. 14. Thus, post 38 has a transverse cross-section at post first end 42 and a transverse cross-section at post second end 44. Post first end 42, which is connected to bottom wall 34, can have a greater transverse cross-sectional extent than post second end 44, which terminates at least near top wall 36. Post 38 transverse cross-sectional extent can taper evenly running in longitudinal direction 58 from first end 42 to second end 44, as a cone. Alternatively, post 38 transverse cross-sectional extent can taper unevenly running in longitudinal direction 58 from first end 42 to second end 44. Alternatively, post 38 transverse cross-sectional extent can be substantially the same running in longitudinal direction 58 of post 38, as a cylinder.

Post 38 transverse cross-section can take on a variety of shapes. These shapes include, but are not limited to, a circle, a triangle, a square, an ellipse, and a rectangle.

Figure 13:
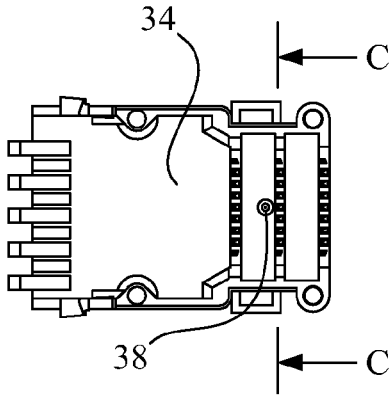
FIG. 13 is a sectional, bottom interior view of the electrical connector in FIG. 12.

In another embodiment of post 38 as shown in FIGS. 13-14, post second end 44 can taper at an angle suitable for piercing mesh sleeve 22. For example, post second end 44 can include a tip 60 which forms a relatively sharp point at approximately a center of transverse cross-section of post second end 44.

Post 38 serves, alone or in combination with teeth 40, to retain within housing 28 end 62 of mesh sleeve 22. Post 38 can be made integral with housing 28 or be made detachable from housing 28.

To assemble electrical assembly 20, post 38 couples with mesh sleeve 22, and mesh sleeve end 62 is retained within housing 28. In coupling post 38 with mesh sleeve 22, post 38 is connected to bottom wall 34 and extends toward top wall 36. In so extending between bottom and top walls 34, 36, post 38 extends transversely through mesh sleeve 22. Post 38 terminates at least near top wall 36. In extending through mesh sleeve 22, post 38 is disposed between at least two wires 24. Additionally, in coupling post 38 with mesh sleeve 22, post 38 can transversely pierce mesh sleeve 22 through bottom and top portions 46, 48 of mesh sleeve 22. Furthermore, electrical assembly 20 can include two opposing ends (only one end shown in drawings), each end including electrical connector 26 coupled with mesh sleeve 22 and wires 24. Each electrical connector 26 includes at least one post 38 which retains within housing 28 ends 62 of mesh sleeve 22.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical connector configured for connecting with a conductor carrier and a plurality of conductors at least partially within the conductor carrier, said electrical connector comprising:

a housing member including a first wall and a second wall, said first and second walls of said housing member forming an exterior of the electrical connector; and at least one post, wherein said at least one post is formed integral with said housing member and is connected to said first wall, extends toward said second wall, terminates at least near said second wall, and is configured for extending through the conductor carrier and retaining within said housing member an end of the conductor carrier, the conductor carrier being detachable relative to said housing member and including a tubular sleeve through which said at least one post extends, said second wall including an inner surface adjacent said at least one post, said inner surface being without either a slot and a hole for receiving said at least one post.

2. The electrical connector of claim 1, wherein said at least one post is a single post.

3. The electrical connector of claim 1, wherein said at least one post contacts said second wall.

4. The electrical connector of claim 1, wherein said at least one post includes a first end and a second end, said first end connected to said first wall, each said first and second ends having a transverse cross-sectional extent, said cross-sectional extent of said first end being greater than said cross-sectional extent of said second end.

5. The electrical connector of claim 1, wherein said at least one post is configured for piercing the conductor carrier.

6. The electrical connector of claim 1, wherein said at least one post includes a transverse cross-section, said transverse cross-section including a shape which is generally one of a circle, a triangle, a square, an ellipse, and a rectangle.

7. An electrical assembly comprising:

a conductor carrier including a tubular sleeve;

a plurality of conductors at least partially within said conductor carrier; and an electrical connector coupled with said plurality of conductors, said electrical connector comprising:

a housing member including a first wall and a second wall, said first and second walls of said housing member forming an exterior of said electrical connector, said conductor carrier being detachable relative to said housing member; and at least one post, wherein said at least one post is formed integral with said housing member and is connected to said first wall, extends toward said second wall, extends through said tubular sleeve of said conductor carrier, and terminates at least near said second wall, said at least one post disposed between at least two of said plurality of conductors, said second wall including an inner surface adjacent said at least one post, said inner surface being without either a slot and a hole for receiving said at least one post.

8. The electrical assembly of claim 7, wherein said at least one post is a single post.

9. The electrical assembly of claim 7, wherein said at least one post contacts said second wall.

10. The electrical assembly of claim 7, wherein said at least one post includes a first end and a second end, said first end connected to said first wall, each said first and second ends having a transverse cross-sectional extent, said cross-sectional extent of said first end being greater than said cross-sectional extent of said second end.

11. The electrical assembly of claim 7, wherein said at least one post transversely pierces said conductor carrier.

12. The electrical assembly of claim 11, wherein said conductor carrier comprises a mesh sleeve.

13. The electrical assembly of claim 7, wherein said at least one post includes a transverse cross-section, said transverse cross-section including a shape which is generally one of a circle, a triangle, a square, an ellipse, and a rectangle.

14. A method of assembling an electrical assembly, comprising the steps of:

providing a conductor carrier including a tubular sleeve, a plurality of conductors at least partially within said conductor carrier, and an electrical connector coupled with said plurality of conductors and including a housing member, said housing member including a first wall and a second wall, said first and second walls of said housing member forming an exterior of said electrical connector, said conductor carrier being detachable relative to said housing member;

coupling said conductor carrier with at least one post, wherein said at least one post is formed integral with said housing member and is connected to said first wall, extends toward said second wall, extends through said tubular sleeve of said conductor carrier, and terminates at least near said second wall, said at least one post disposed between at least two of said plurality of conductors, said second wall including an inner surface adjacent said at least one post, said inner surface being without either a slot and a hole for receiving said at least one post; and retaining within said housing member an end of said conductor carrier.

15. The method of claim 14, wherein said at least one post is a single post.

16. The method of claim 14, wherein said at least one post contacts said second wall.

17. The method of claim 14, wherein said at least one post includes a first end and a second end, said first end connected to said first wall, each said first and second ends having a transverse cross-sectional extent, said cross-sectional extent of said first end being greater than said cross-sectional extent of said second end.

18. The method of claim 14, wherein said coupling step includes said at least one post transversely piercing said conductor carrier.

19. The method of claim 18, wherein said conductor carrier comprises a mesh sleeve.

20. The method of claim 14, wherein said at least one post includes a transverse cross-section, said transverse cross-section including a shape which is generally one of a circle, a triangle, a square, an ellipse, and a rectangle.

* * * * *